US006074327A

United States Patent [19]

Franklin

[11] Patent Number: 6,074,327

[45] Date of Patent: Jun. 13, 2000

[54] CLIMBING HOLD WITH REINFORCING SLEEVE

[75] Inventor: Scott Franklin, Bend, Oreg.

[73] Assignee: Black Diamond Equipment, Ltd., Salt Lake City, Utah

[21] Appl. No.: 09/111,105

[22] Filed: Jul. 6, 1998

Related U.S. Application Data

[60] Provisional application No. 60/054,731, Aug. 5, 1997.

[51] Int. Cl.[7] ..... A63B 29/04

[52] U.S. Cl. ..... 482/37; 482/35; 482/51; 248/231.9; 248/903; 249/55

[58] Field of Search ..... 482/35, 37, 51, 482/904; 248/925, 903, 231.9; 249/55, 98; 411/546, 531, 258, 82, 180

[56] References Cited

U.S. PATENT DOCUMENTS

| | | | |
|---|---|---|---|
| 2,250,580 | 7/1941 | Gregory | 411/82 |
| 5,125,877 | 6/1992 | Brewer . | |
| 5,254,058 | 10/1993 | Savigny . | |
| 5,256,116 | 10/1993 | Robinson . | |
| 5,350,265 | 9/1994 | Kinner | 411/546 |

FOREIGN PATENT DOCUMENTS

| | | | |
|---|---|---|---|
| 2578166 | 9/1986 | France | 482/37 |
| 2 623 412 | 5/1989 | France . | |
| 2623412 | 5/1989 | France | 482/37 |
| 2628978 | 9/1989 | France | 482/37 |
| 2 666 017 | 2/1992 | France . | |
| 2 628 978 | 9/1998 | France . | |
| 1802224 | 5/1970 | Germany | 411/531 |
| 1455235 | 11/1976 | United Kingdom | 411/531 |
| 2267651 | 12/1993 | United Kingdom | 482/37 |

OTHER PUBLICATIONS

Metolius Mountain Products, Building a Climbing Wall, Bend, Oregon, received in the PTO Mar. 1997.

*94–95 Metrolius Catalog*, Metrolius, Bend, Oregon, 1994.

*95–96 Pusher Catalog*, Pusher, Salt Lake City, Utah, 1995.

*96 Franklin Climbing Catalog*, Franklin Climbing Equipment, Bend, Oregon, 1996.

*96 Nicros Catalog*, Nicros Inc., St. Paul, Minnesota, 1996.

*96 Entre Prises Catalog*, Entre Prises USA, Bend, Oregon, 1996.

*Primary Examiner*—Richard J. Apley
*Assistant Examiner*—Victor K. Hwang
*Attorney, Agent, or Firm*—Hoffmann & Baron, LLP

[57] ABSTRACT

A climbing hold for mounting on a front face of a climbing wall with a fastener. The climbing hold includes a hold body and a reinforcing sleeve. The hold body has an exterior portion adapted to support a climber and a substantially planar mounting face adapted to engage the front face of the climbing wall. The reinforcing sleeve is secured within the hold body and has first and second ends with an aperture extending longitudinally therethrough adapted to accommodate the fastener for mounting the climbing hold to the climbing wall. The reinforcing sleeve substantially isolates the hold body from fastening forces that result from mounting the climbing hold to the climbing wall.

17 Claims, 8 Drawing Sheets

CLIMBING HOLD WITH REINFORCING SLEEVE

This application claims the benefit of U.S. Provisional Application No. 60/054,731, filed on Aug. 5, 1977.

FIELD OF INVENTION

The present invention relates to a climbing hold which is securable to a man made climbing wall. More specifically, the present invention relates to an insert securable within the climbing hold for providing reinforcement thereto.

BACKGROUND OF THE INVENTION

The sport of rock climbing is becoming ever more popular as a means of recreation. In order to develop the necessary skills to participate in this sport, many individuals practice on a simulation device which typically includes a climbing wall containing a plurality of man made climbing holds fastened thereto. Climbing of these man made walls has also become a sport of its own, with walls being designed to accommodate the various skill levels of climbers.

Climbing holds are grabbed and stepped by a climber in order to ascend up the wall. Its important for the holds to be rigidly secured to the climbing wall in order to prevent the hold from moving under the weight of a climber. Climbing holds come in a variety of configurations in order to simulate various naturally occurring rock formations. Such holds are typically formed of synthetic material such as a polyester resin which allows the holds to take on the appearance and texture of natural rock.

Prior art climbing holds present significant problems when attempting to properly secure them to a climbing wall. Climbing holds typically have an aperture extending therethrough in order to permit a bolt to extend and threadably engage the climbing wall. The bolt is tightened to secure the climbing hold to the wall and prevent the hold from either translational or rotational movement. In order to ensure that the hold does not rotate, a bolt must be tightened to a certain degree such that the hold is urged against the wall and prevented from rotating by the frictional force existing between the planar mounting face of the hold and the opposing portion of the climbing wall. However, in attempting to prevent the climbing hold from moving, the bolt may be over tightened resulting in the molded body of the climbing hold to fracture. The head of the bolt upon engaging the upper body portion of the climbing hold creates an area of high stress concentration adjacent to the bolt head making the hold susceptible to cracking about this area. Accordingly, a narrow acceptable range of torque results in order to ensure that the climbing hold is properly secured but not damaged. Fracture of the hold may lead to the hold falling from the wall upon being stressed by the weight of a climber. Since a climber may place all of their weight on a particular hold, its breaking may result in a fall which could injure the climber.

The present invention overcomes the problems associated with the prior art climbing holds by providing a device for reinforcing the climbing hold such that the bolt may be tightened without resulting in damage to the climbing hold. The present invention further includes a method of attaching a climbing hold to a climbing wall so that the hold may be securely fastened to the climbing wall without fracturing.

SUMMARY OF THE INVENTION

It is an object of the present invention to provide a climbing hold which is capable of being securely fastened to a climbing wall without fracturing.

It is another object of the present invention to provide a climbing hold including a reinforcing sleeve extending therethrough to accommodate a fastener.

In accordance with one form of the present invention a climbing hold includes a hold body and a reinforcing sleeve. The hold body has an exterior portion for supporting a climber and a substantially planar mounting face that engages the front face of a climbing wall. The reinforcing sleeve is secured within the hold body and has first and second ends with an aperture extending longitudinally therethrough for accommodating a fastener to mount the climbing hold to the climbing wall. The reinforcing sleeve substantially isolates the hold body from forces that result from fastening and using the climbing hold. Preferably, the second end of the reinforcing sleeve is substantially flush with the planar mounting face of the hold body In a preferred embodiment the reinforcing sleeve includes a tubularly shaped intermediate portion, a radially extending first end face having a perimeter and is attached to the first end to prevent translation of the hold body with respect to the reinforcing sleeve when mounted to the climbing wall. The reinforcing sleeve may also include a radially extending second end face having a perimeter and is attached to the second end to prevent translation of the hold body with respect to the reinforcing sleeve. The first and second end faces may also include side surfaces with the perimeters of the first and second end faces being formed to engage the hold body to prevent the reinforcing sleeve from rotating relative to the hold body. The perimeters of the first and second end faces are preferably in the form of either a hexagon or are formed with a plurality of radially inwardly extending slots.

In another preferred embodiment the aperture and the first end face of the reinforcing sleeve is preferably adapted to accommodate the fastener, which includes a shaft and a head, such that the shaft passes through the aperture and the head engages the first end face. The first end of the reinforcing sleeve may include a beveled countersink to guide the fastener through the aperture.

In yet another preferred embodiment the second end face of the reinforcing sleeve is substantially flush with the planar mounting face of the hold body and also includes a plurality of cleats that engage the climbing wall when mounted thereon to prevent rotation of the climbing hold.

The present invention also provides a method of attaching a climbing hold to a climbing wall which includes providing a climbing hold including a hold body having an exterior portion adapted to support the climber and a planar mounting face adapted to engage the front face of the climbing wall. Providing a reinforcing sleeve fixedly secured within the hold body having first and second ends with an aperture extending longitudinally therethrough and adapted to accommodate a fastener for mounting the climbing hold to the climbing wall. Locating the climbing hold on the climbing wall and securing the climbing hold to the climbing wall with the fastener such that the shaft thereof passes through the reinforcing sleeve and the fastener head engages the sleeve.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
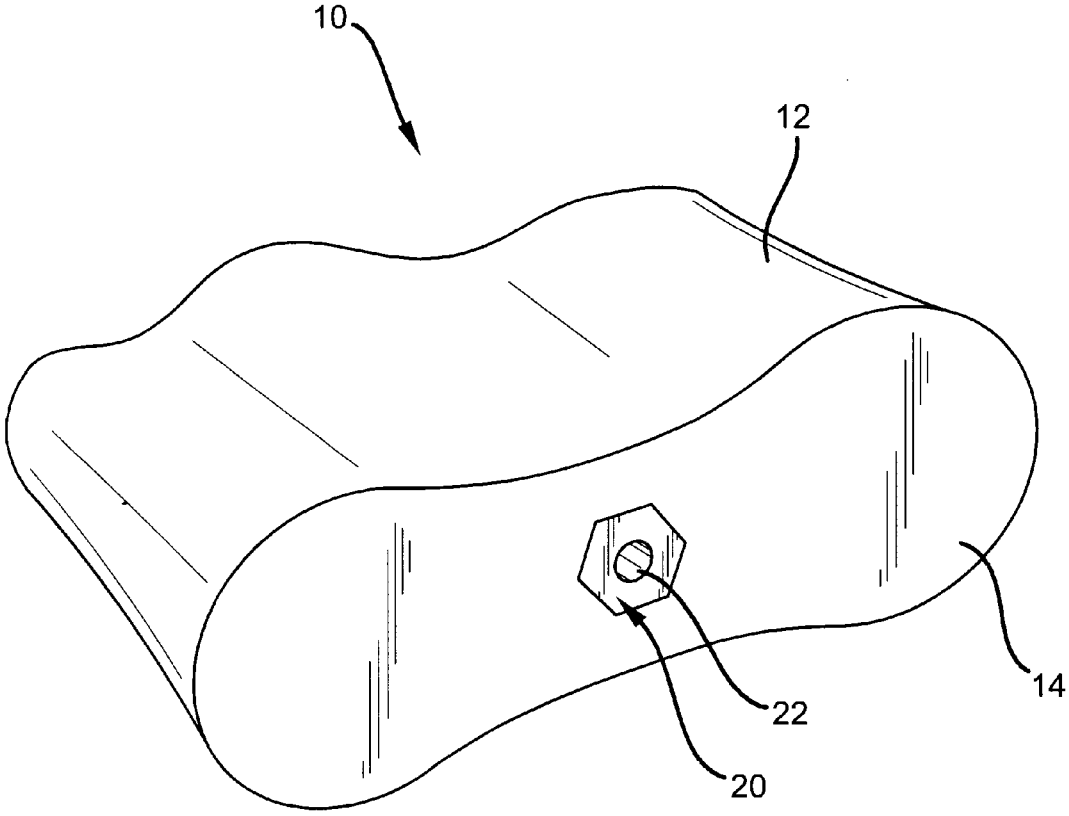
FIG. 1 is a perspective view of the climbing hold of the present invention.
Figure 2:
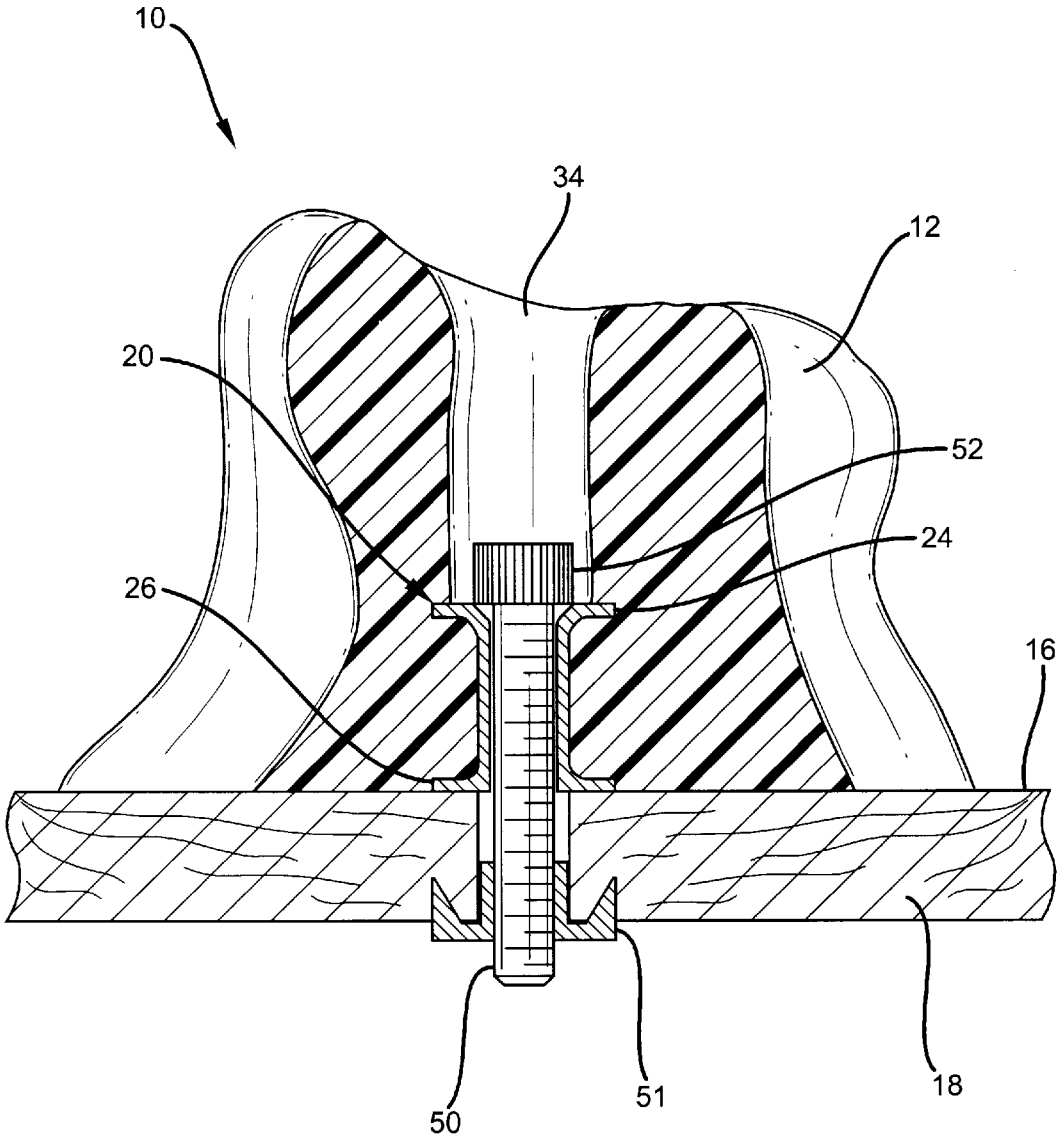
FIG. 2 is a vertical cross-sectional view of the climbing hold of the present invention secured to a climbing wall.

The climbing hold 10 of the present invention is shown in FIG. 1. Climbing hold 10 includes a hold body 12 having a planar mounting face 14 which engages a front surface 16 of climbing wall 18 as shown in FIG. 2. The hold body 12 may be of any of a variety of amorphous design having a configuration in order to simulate a natural rock formation. Hold body 12 provides a surface to which a climber may either grab or stand upon in order to traverse the climbing wall. The hold body 12 may be formed of a molded polyester resin which allows the hold body 12 to be formed in a variety of shapes and sizes in order to accommodate a particular design requirement. Climbing hold 10 may also be formed of a variety of materials such as ceramic, cement, stone, epoxy resin or wood. Climbing hold 10 is securable to a climbing wall 18 by way of a fastener such as a bolt 50 which is threadably engagable with a piece of mounting hardware 51 embedded in wall 18. Climbing wall 18 is typically a man made structure having a plywood covering.

Figure 3:
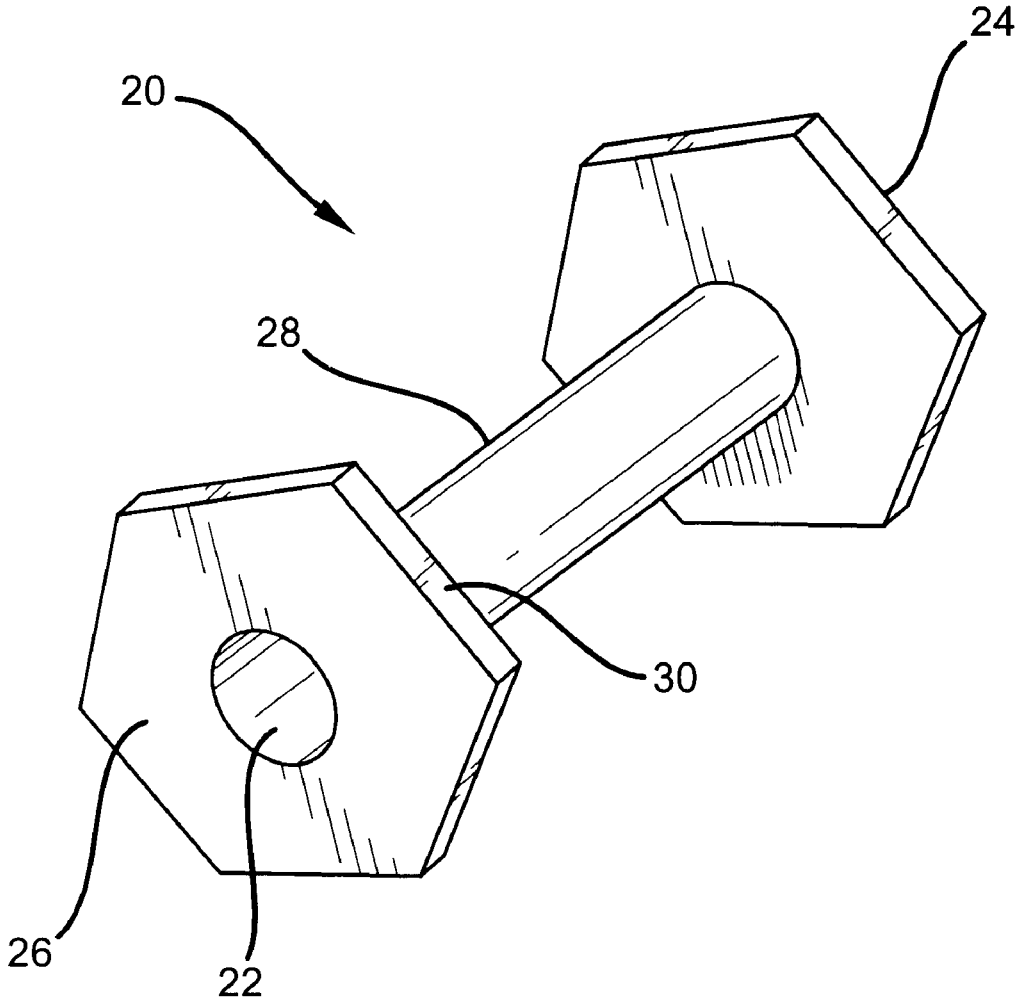
FIG. 3 is a perspective view of a reinforcing sleeve of the present invention.

With further reference to FIGS. 2 and 3, in order to prevent damage to climbing hold 10 upon attachment to the climbing wall or during use by a climber, a reinforcing sleeve 20 is provided which may be fixedly secured within the hold body 12. The reinforcing sleeve substantially isolates the hold body from forces that result from mounting, and using the climbing hold. Reinforcing sleeve 20 is preferably secured in hold body 12 by molding the hold body 12 around reinforcing sleeve 20. Reinforcing sleeve 20 includes an aperture 22 longitudinally extending therethrough to provide a clearance opening for bolt 50. Sleeve 20 further includes a radially extending first and second end face 24, 26 having a tubularly shaped intermediate portion 28 extending therebetween. The length of intermediate portion 28 may be adjusted depending on the thickness of hold body 12 adjacent to the location of sleeve 20. Sleeve 20 is molded in hold body 12 such that second end face 26 is substantially flush with mounting face 14 in order to permit climbing hold 10 to be properly mounted to wall 18. First end face 24 is preferably positioned a distance from the upper surface of hold body 12 so that the head of bolt 50 will not protrude from hold body 12. Sleeve 20 is secured against axial translation within hold body 12 by the body resin material formed between first and second end faces 24,26.

Figure 4:
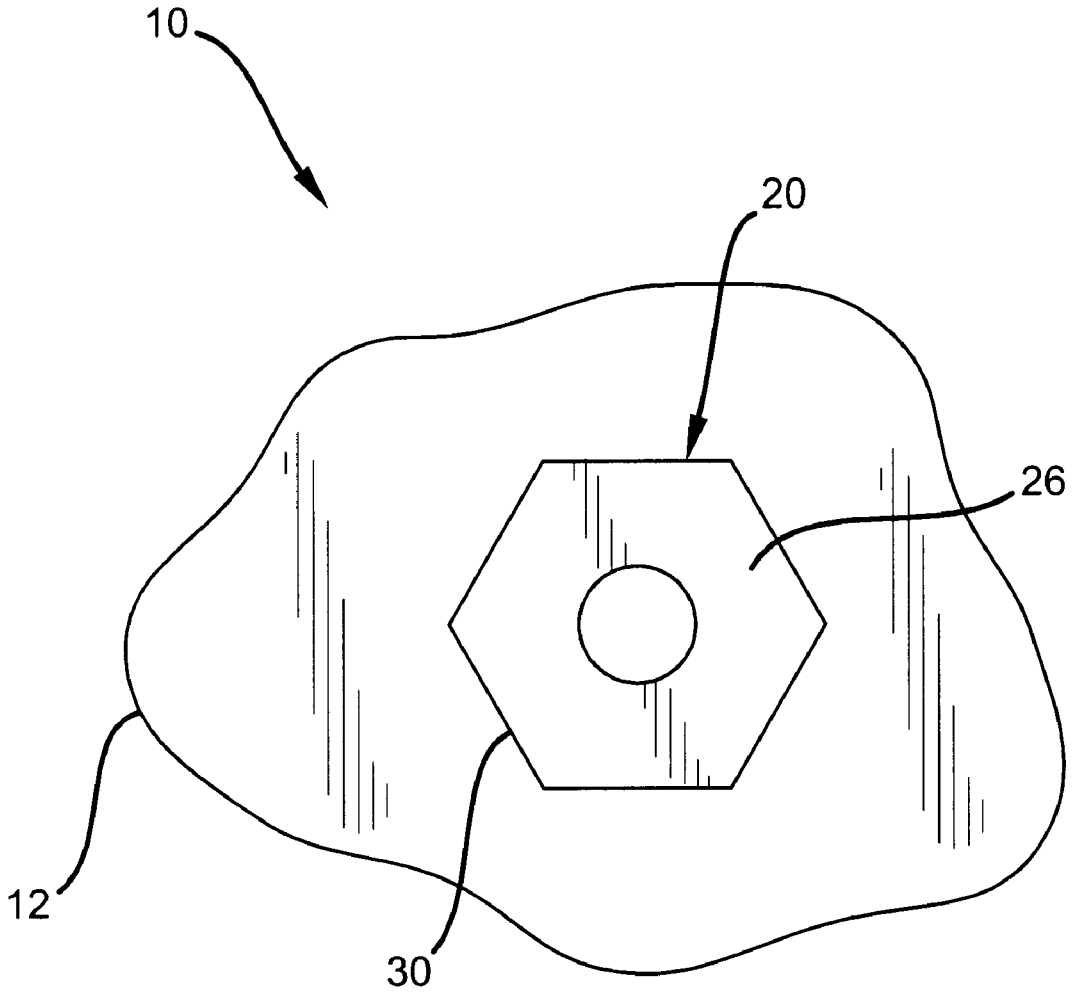
FIG. 4 is a bottom elevational view of the climbing hold of the present invention.
Figure 5:
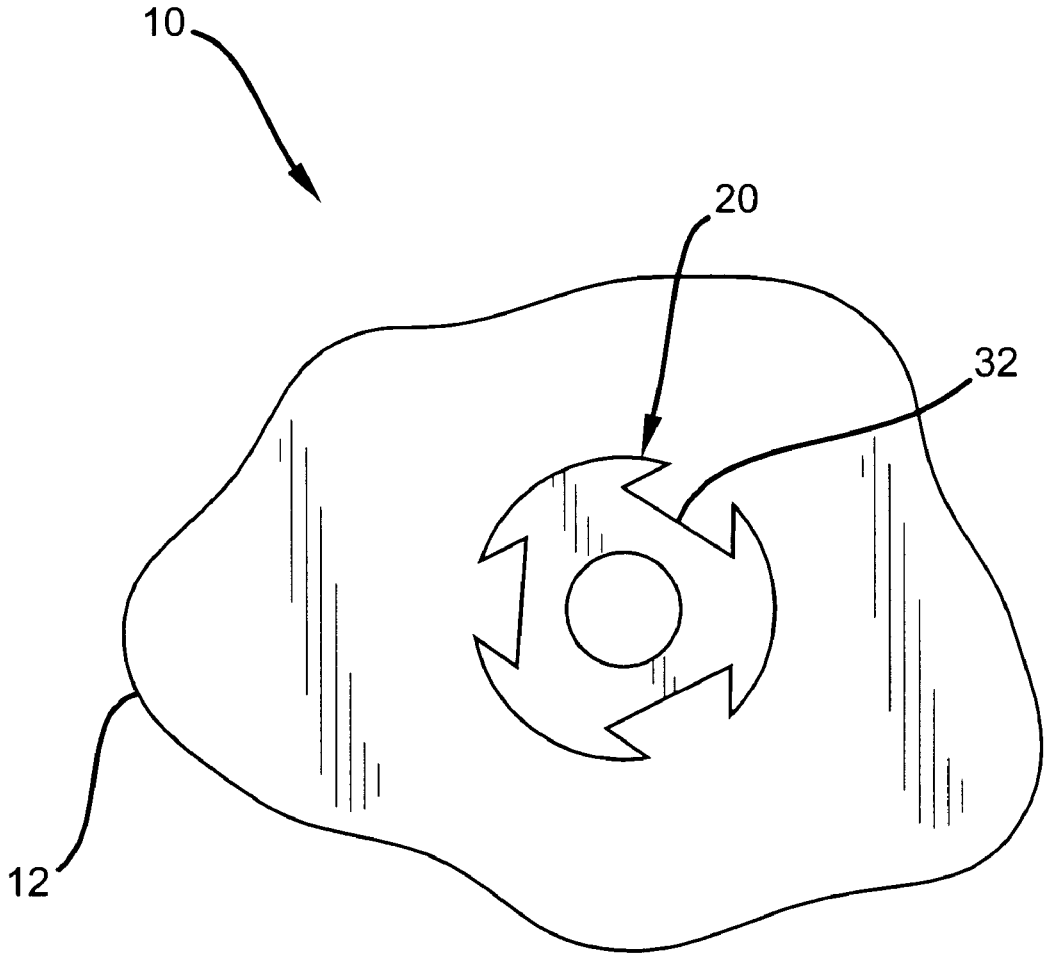
FIG. 5 is a bottom elevational view of the climbing hold depicting an alternative embodiment of the reinforcing sleeve.

First and second end faces 24,26 preferably include side surfaces 30 which assist in preventing reinforcing sleeve 20 from rotating relative to hold body 12. First and second end faces 24,26 may be similarly configured in the form of a polygon such as a hexagon as shown in FIGS. 3 and 4. When these sides are molded in the body forming resin, they abut the resin and will prevent sleeve 20 from rotating. In an alternative embodiment shown in FIG. 5, first and second end faces 24,26 may include radially inwardly extending slots 32 in which molded material may extend thereby preventing reinforcing sleeve 20 from rotating within hold body 12.

Figure 8:
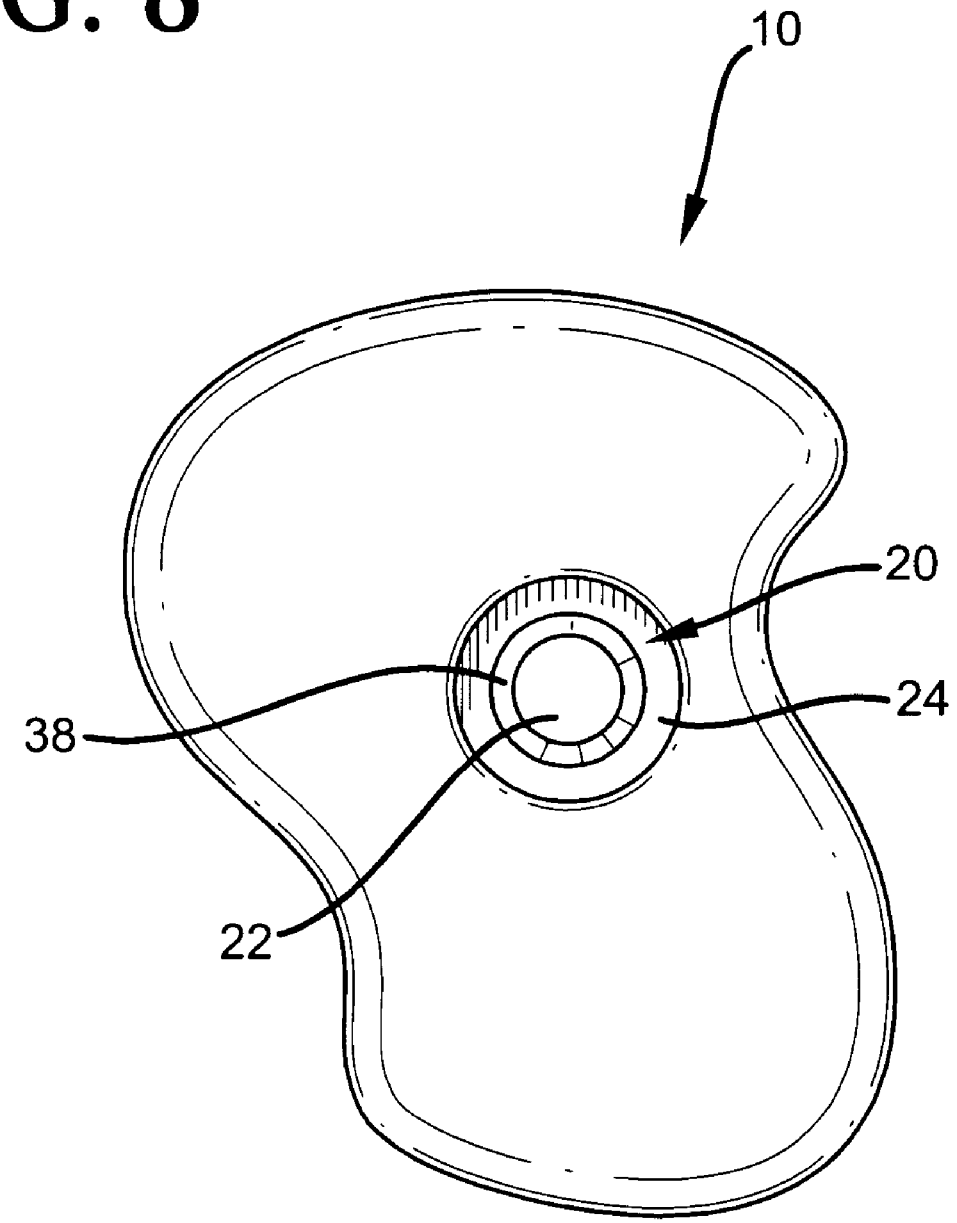
FIG. 8 Is plan elevational view of the climbing hold of FIG. 1.

Referring to FIGS. 2 and 8, hold body 12 includes an opening 34 which is concentric with reinforcing sleeve aperture 22. Opening 34 permits a bolt 50, including its head 52, to be extended therethrough. Sleeve aperture 22 is sized such that the head of the bolt 52 will not pass therethrough but will instead be supported by first end face 24. In addition, referring to FIG. 6, climbing hold aperture 22 may include a beveled countersink 38 adjacent first end face 24 in order to permit ease of insertion of bolt 50 into aperture 22.

In order to secure the climbing hold 10 to wall 18, bolt 50, or an equivalent fastener, is inserted through hold body opening 34 and sleeve aperture 22. Hold 50 is then threadably advanced which forces the climbing hold mounting face 14 against the front surface 16 of the wall. The force of the bolt 50 acts over relatively small area adjacent to the under surface of bolt head 52 resulting in high pressures being exerted on reinforcing sleeve 20. The construction of sleeve 20 allows it to withstand the forces and prevent those forces from being inflicted on the hold body. The tightening of bolt 50 tends to urge mounting face 14 against climbing wall front surface 16. While threaded engagement of bolt 50 into wall 18 prevents translational movement of hold 10, rotational movement about bolt 50 is prevented by the frictional force created between hold mounting face 14 and wall front surface 16.

In order to adequately prevent rotation when acted upon by a loading such as the weight of a climber bolt 50 must be sufficiently torqued down to urge mounting face 14 and wall 18 into forced engagement. Even if bolt 50 is over tightened, reinforcing sleeve 20 will accommodate such increase loadings and protect hold 10 from damage. The rugged nature of reinforcing sleeve 20 allows for bolt 50 to be tightened to such a degree that climbing hold 10 will be rigidly fixed to climbing wall 18 without fracturing hold body 12. Sleeve 20 also protects climbing hold 10 from damage due to forces imparted thereon by a climber.

Figure 6:
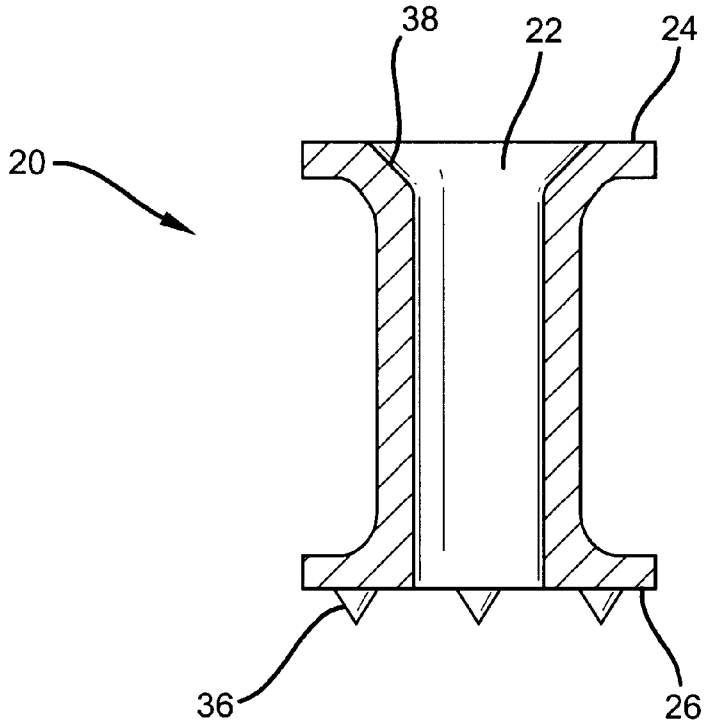
FIG. 6 is a side elevational view of an alternative embodiment of the reinforcing sleeve of the present invention.
Figure 7:
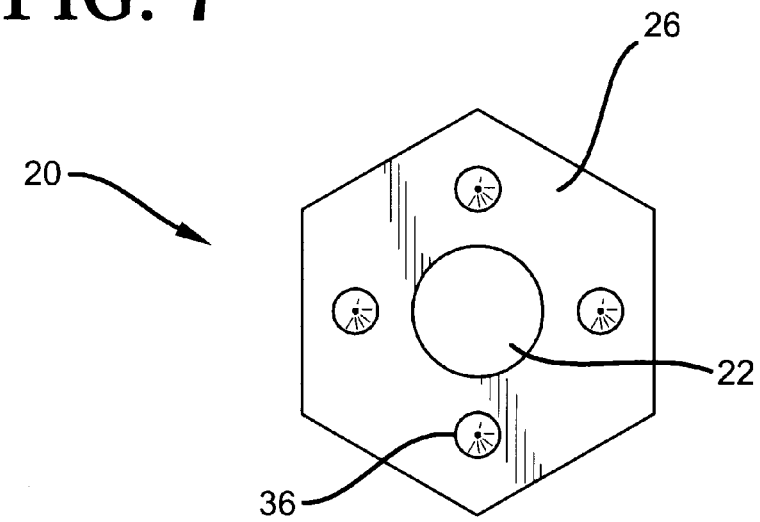
FIG. 7 is a bottom elevational view of the reinforcing sleeve of FIG. 6.

In an alternative embodiment, the second end face 26 of the reinforcing sleeve may include a device for further preventing rotation of a climbing hold 10. As shown in FIGS. 6 and 7, second end face 26 may include a plurality of outwardly projecting cleats 36. When sleeve 20 is molded within hold body 12, cleats 36 extend beyond climbing hold mounting face 14 to engage wall 18. Upon engaging climbing wall 18, cleats 36 will be driven into wall front surface 16 thereby providing a further means for resisting any rotation of climbing hold 10.

Figure 9:
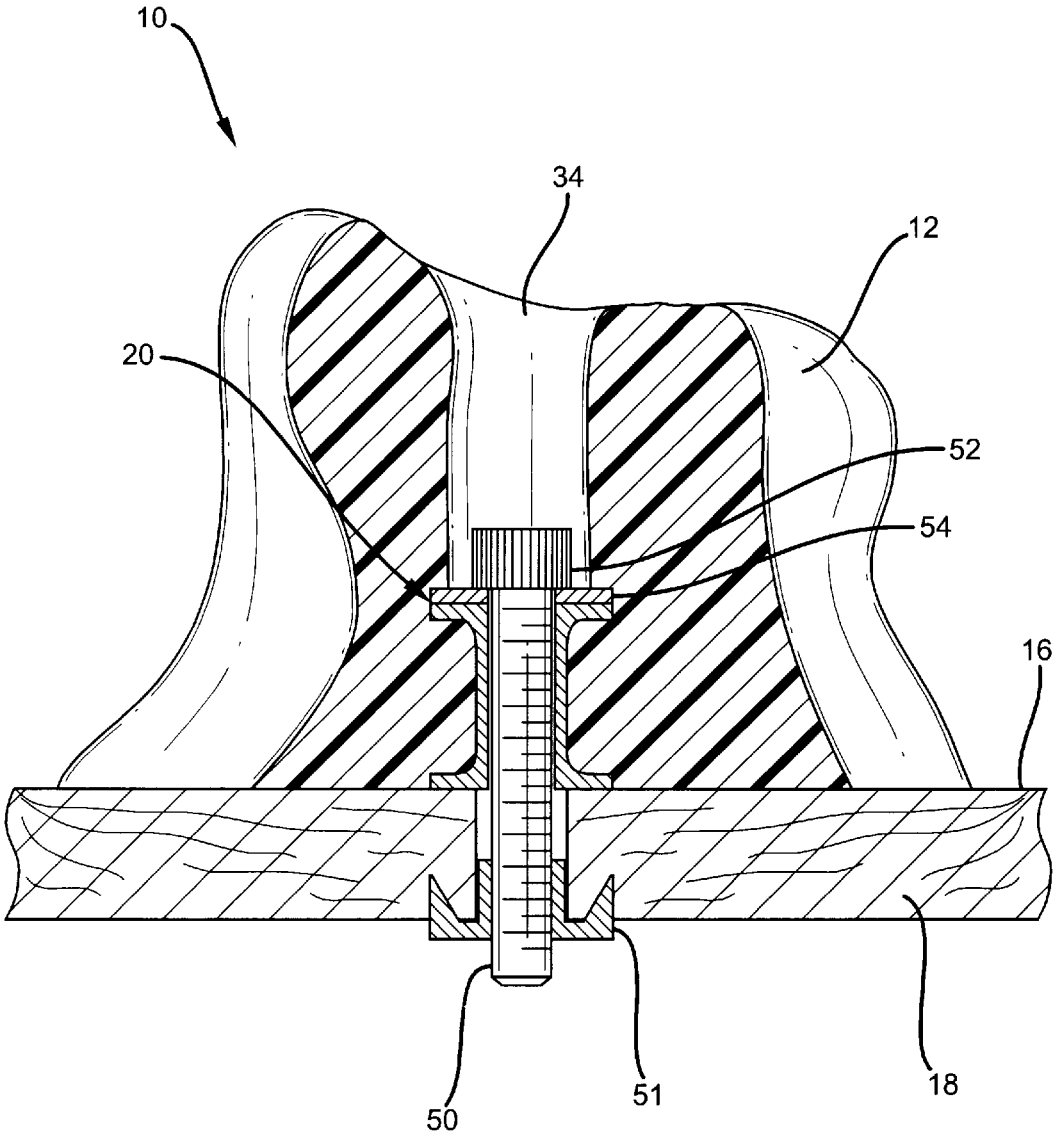
FIG. 9 is a vertical cross-sectional view of an alternative embodiment of the climbing hold of the present invention.

In a further alternative embodiment shown in FIG. 9, a washer 54 may be molded within climbing hold 10 adjacent to the first end face 24 of the reinforcing sleeve. Washer 54 may be formed of steel and will prevent any gouging of sleeve 20 caused by the engagement therewith of bolt head 52 upon tightening of bolt 50. Washer 54 is particularly useful in applications in which reinforcing sleeve 20 is formed out of a somewhat soft material such as aluminum or brass. In this embodiment, sleeve 20 may be formed without countersink 38.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A climbing hold for mounting on a climbing wall with a fastener, said climbing hold comprising:

a hold body having an exterior portion adapted to support a climber and a substantially planar mounting face adapted to engage the climbing wall; and a reinforcing sleeve secured within said hold body and having first and second ends with an aperture extending longitudinally therethrough adapted to accommodate the fastener for mounting said climbing hold to the climbing wall, said reinforcing sleeve being positioned to support a portion of the fastener and engage the climbing wall to substantially isolate said hold body from forces that result from mounting said climbing hold to the climbing wall.

2. A climbing hold as defined in claim 1, wherein said second end of said reinforcing sleeve is substantially flush with said planar mounting face of said hold body.

3. A climbing hold as defined in claim 2, wherein said reinforcing sleeve first end supports a head of the fastener.

4. A climbing hold as defined in claim 1, wherein said reinforcing sleeve includes:

a tubularly shaped intermediate portion extending between said first and second ends; and a radially extending first end face having a perimeter and attached to said first end to prevent translation of said hold body with respect to said reinforcing sleeve when mounted to the climbing wall.

5. A climbing hold as defined in claim 4, wherein said reinforcing sleeve further includes a radially extending second end face having a perimeter and attached to said second end to prevent translation of said hold body with respect to said reinforcing sleeve.

6. A climbing hold as defined in claim 5, wherein said first and second end faces further include side surfaces and said perimeters of said first and second end faces are formed to engage said hold body to prevent said reinforcing sleeve from rotating relative to said hold body.

7. A climbing hold as defined in claim 6, wherein said perimeters of said first and second end faces are in the form of a hexagon.

8. A climbing hold as defined in claim 6, wherein said perimeters of said first and second end faces are formed with a plurality of radially inwardly extending slots.

9. A climbing hold as defined in claim 5, wherein said second end face of said reinforcing sleeve is substantially flush with said planar mounting face of said hold body and further includes a plurality of cleats adapted to engage the climbing wall when mounted thereon to prevent rotation of said climbing hold.

10. A climbing hold as defined in claim 4, wherein said aperture and said first end face of said reinforcing sleeve are adapted to accommodate the fastener, which includes a shaft and a head, such that the shaft passes through said aperture and the head engages said first end face.

11. A climbing hold as defined in claim 1, wherein said first end of said reinforcing sleeve includes a beveled countersink to guide the fastener through said aperture.

12. A climbing hold as defined in claim 1, wherein said hold body is formed from a polyester resin.

13. A climbing hold as defined in claim 1, wherein said hold body is formed from a material selected from the group consisting of ceramic, cement, stone, epoxy resin, and wood.

14. A climbing hold as defined in claim 1, wherein said reinforcing sleeve is formed from a metal.

15. A climbing hold as defined in claim 1, wherein said reinforcing sleeve is formed from a material selected from the group consisting of aluminum, steel, brass, and acetal resin.

16. A climbing hold as defined in claim 1, further comprising a washer formed with a hole, said washer being secured within said hold body adjacent to said first end of said reinforcing sleeve such that said hole is concentrically aligned with said aperture of said reinforcing sleeve.

17. A method of attaching a climbing hold to a climbing wall, said method comprising the steps of:

providing a fastener comprising a shaft and a head;

providing a climbing hold comprising;

a hold body having an exterior portion adapted to support a climber and a planar mounting face adapted to engage a front face of the climbing wall; and a reinforcing sleeve fixedly secured within said hold body having first and second ends with an aperture extending longitudinally therethrough adapted to accommodate the fastener for mounting said climbing hold to the climbing wall, said reinforcing sleeve being position in said hold such that said reinforcing sleeve second end is substantially flush with said hold body mounting face;

locating said climbing hold on said climbing wall; and securing said climbing hold to said climbing wall with said fastener such that said shaft passes through said reinforcing sleeve and said head engages said reinforcing sleeve and said sleeve second end engages the front face of the climbing wall thereby substantially isolating said hold body from forces that result from mounting said climbing hold.

* * * * *